US010234809B2

(12) United States Patent
Satake

(10) Patent No.: US 10,234,809 B2
(45) Date of Patent: Mar. 19, 2019

(54) IMAGE FORMING APPARATUS

(71) Applicant: KYOCERA Document Solutions Inc., Osaka (JP)

(72) Inventor: Kenichi Satake, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 16 days.

(21) Appl. No.: 15/492,774

(22) Filed: Apr. 20, 2017

(65) Prior Publication Data

US 2017/0315493 A1 Nov. 2, 2017

(30) Foreign Application Priority Data

Apr. 28, 2016 (JP) ..... 2016-090876

(51) Int. Cl.
*G03G 15/00* (2006.01)

(52) U.S. Cl.
CPC ..... *G03G 15/6561* (2013.01); *G03G 15/6558* (2013.01); *G03G 2215/00675* (2013.01)

(58) Field of Classification Search
CPC ..... G03G 15/6561; G03G 15/6558; G03G 2215/00675; B65H 1/00
See application file for complete search history.

(56) References Cited

U.S. PATENT DOCUMENTS 4,768,055 A * 8/1988 Takamatsu ..... G03G 15/0822 399/102
4,803,510 A * 2/1989 Maeda ..... G03G 21/1814 399/114
4,941,015 A * 7/1990 Komai ..... G03G 21/1832 346/145
5,132,731 A * 7/1992 Oda ..... G03G 15/0898 399/301
5,189,469 A * 2/1993 Endo ..... G03G 15/1635 271/226
5,659,837 A * 8/1997 Jo ..... G03G 15/0865 399/111
5,745,823 A * 4/1998 Goto ..... G03G 21/1853 399/111

(Continued)

FOREIGN PATENT DOCUMENTS

JP 2007-248826 A 9/2007
JP 2011-2594 A 1/2011

*Primary Examiner* — David H Banh
(74) *Attorney, Agent, or Firm* — Stein IP, LLC

(57) ABSTRACT

An image forming apparatus includes an image carrier, a charging device, a developing device, a transfer member, a registration roller pair, a conveyance guide, and a first cover member. The conveyance guide includes a first conveyance guide opposing one surface of a recording medium conveyed from the registration roller pair to a transfer nip, the one surface being on a side of image carrier, and a second transfer guide opposing another surface of the recording member, the other surface being on a side of the transfer member. The first cover member covers an area along a peripheral surface of the image carrier from the developing device to the transfer member, and forms a substantially sealed space together with the image carrier, the developing device, the transfer member, the registration roller pair, and the transfer guide. A through hole is formed in the first transfer guide.

8 Claims, 7 Drawing Sheets

(56) References Cited

U.S. PATENT DOCUMENTS

| | | | | |
|---|---|---|---|---|
| 2002/0118980 | A1* | 8/2002 | Dycher | G03G 21/1832 399/114 |
| 2004/0042823 | A1* | 3/2004 | Sugiura | G03G 21/0058 399/174 |
| 2004/0101327 | A1* | 5/2004 | Nomura | B41J 2/45 399/111 |
| 2005/0019683 | A1* | 1/2005 | Tomoyori | G03G 5/047 430/63 |
| 2006/0285882 | A1* | 12/2006 | Shimmura | G03G 9/0821 399/222 |
| 2009/0028606 | A1* | 1/2009 | Fujita | G03G 21/0035 399/175 |
| 2010/0181717 | A1* | 7/2010 | Sumikura | G03G 15/6573 271/90 |
| 2010/0322662 | A1 | 12/2010 | Kusakabe | 399/92 |
| 2012/0251155 | A1* | 10/2012 | Ishikawa | G03G 15/0806 399/92 |
| 2013/0135423 | A1* | 5/2013 | Imai | G02B 26/12 347/224 |
| 2014/0376951 | A1* | 12/2014 | Ogawa | G03G 15/0898 399/98 |

* cited by examiner

IMAGE FORMING APPARATUS

INCORPORATION BY REFERENCE

This application is based upon and claims the benefit of priority from the corresponding Japanese Patent Application No. 2016-090876 filed on Apr. 28, 2016, the entire contents of which are incorporated herein by reference.

BACKGROUND

The present disclosure relates to an image forming apparatus employing an electro-photographic method, such as a copier, a printer, a facsimile machine, or a multifunction peripheral having functions of these.

In a conventional image forming apparatus employing an electro-photographic process, the following process is typically performed. A surface of an image carrier such as a photosensitive drum is uniformly charged by a charging device, then the surface of the image carrier is exposed to light (light irradiation) from an exposure device to form an electrostatic latent image on the image carrier, and then the thus formed electrostatic latent image is developed into a toner image by a developing device. A sheet (a recording medium) is conveyed from a registration roller pair in a manner coordinated with the timing of toner image formation, then the toner image is transferred onto the sheet passing through a transfer nip at which the photosensitive drum and a transfer roller contact each other, and then fixing processing is performed.

In the above-described configuration, in a case where a horizontal conveyance method is adopted in which sheets are conveyed in a horizontal direction, the developing device is located above a sheet conveyed from the registration roller pair to the photosensitive drum. This arrangement involves risk of a sheet becoming stained with toner leaked from the developing device.

To address this inconvenience, there have been proposed various methods for reducing the risk of stained sheets, and for example, there is known an image forming apparatus which includes a transfer guide member which restricts a position that a recording medium assumes while it is being conveyed toward a transfer position, and in which an air-flow guide member is provided in the transfer guide member to be opposite the image carrier, the air-flow guide guiding an air flow moving along the image carrier from a developing position to the transfer position to move in a direction away from the image carrier.

There is also known an image forming apparatus which includes a guide which is provided on a downstream side of a developing device but on an upstream side of a transfer roller to guide a sheet to between the transfer roller and a photosensitive drum, a fan which generates a second air flow which is different from a first air flow generated by rotation of the photosensitive drum and which passes below the guide, and a flow path which is provided on an upstream side of a sheet path through which a sheet passes but on the downstream side of the developing device, and which guides part of the first air flow to the second air flow.

SUMMARY

According to one aspect of the present disclosure, an image forming apparatus includes an image carrier, a charging device, a developing device, a transfer member, a registration roller pair, a conveyance guide, and a first cover member. The charging device charges a surface of the image carrier by applying a charging bias to the surface of the image carrier. The developing device is arranged on a downstream side of the charging device with respect to a rotation direction of the image carrier, includes a developer carrier which opposes the image carrier with a predetermined developing gap therebetween, and develops the electrostatic latent image formed on the image carrier. The transfer member is arranged on a downstream side of the developing device with respect to the rotation direction of the image carrier, and transfers a toner image formed on the image carrier onto a recording medium. The registration roller pair conveys the recording medium to a transfer nip between the transfer member and the image carrier at a predetermined timing. The conveyance guide includes a first conveyance guide opposing one surface of the recording medium conveyed from the registration roller pair to the transfer nip, the one surface being on a side of the image carrier, and a second conveyance guide opposing another surface of the recording medium, the other surface being on a side of the transfer member. The first cover member covers an area along a peripheral surface of the mage carrier from the developing device to the transfer member. The first cover member, together with the image carrier, the developing device, the transfer member, the registration roller pair, and the conveyance guide, forms a substantially sealed space. A through hole is formed in the first conveyance guide.

Further features and specific advantages of the present disclosure will become apparent from the following descriptions of preferred embodiments.

DETAILED DESCRIPTION

Figure 1:
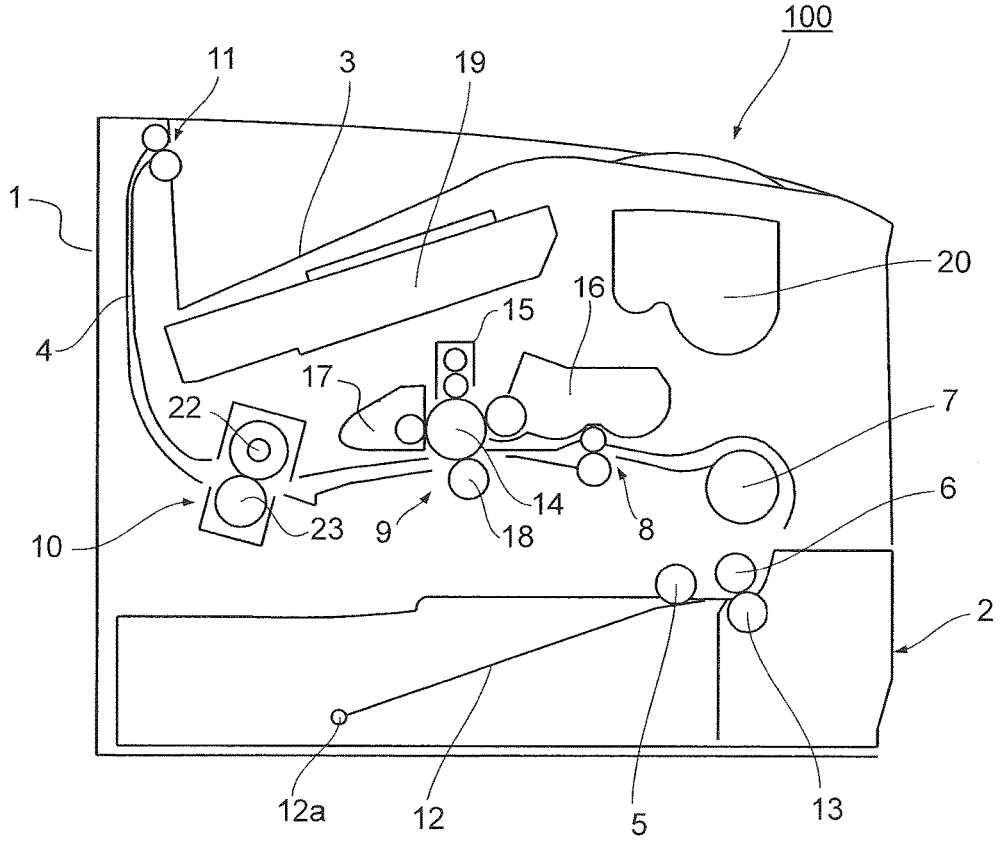
FIG. 1 is a schematic diagram illustrating an overall configuration of an image forming apparatus according to a first embodiment of the present disclosure.

Hereinafter, embodiments of the present disclosure will be described with reference to the drawings. FIG. 1 is a diagram schematically illustrating an overall configuration of an image forming apparatus 100 according to a first embodiment of the present disclosure. The figure illustrates the image forming apparatus 100 in such a manner that its front side is located on the right side in the figure. As illustrated in FIG. 1, the image forming apparatus 100 (here, a monochrome printer) includes a sheet feeding cassette 2, which is arranged in a lower part of an apparatus main body 1, and in which sheets are accommodated in a stacked manner. Above the sheet feeding cassette 2, there is formed a sheet conveyance path 4 which substantially horizontally extends from front to back of the apparatus main body 1 to further extend upward to reach a sheet delivery part 3, which is formed at an upper face of the apparatus main body 1. Along the sheet conveyance path 4, there are arranged a pickup roller 5, a feed roller 6, an intermediate conveyance roller 7, a registration roller pair 8, an image forming part 9, a fixing device 10, and a delivery roller pair 11, in this order from an upstream side.

The sheet feeding cassette 2 is provided with a sheet stacking plate 12 supported by a pivot 12*a* provided in a back end part of the sheet feeding cassette 2 in a sheet conveyance direction. The sheet stacking plate 12 is pivotable with respect to the sheet feeding cassette 2. By the sheet stacking plate 12 pivoting upward, sheets (recording media) stacked on the sheet stacking plate 12 are pressed against the pickup roller 5. In a front-side part of the sheet feeding cassette 2, there is disposed a retard roller 13 to be pressed against the feed roller 6. If two or more sheets are simultaneously fed by the pickup roller 5, the two or more sheets are separated from each other by the feed roller 6 and the retard roller 13, so that a topmost one of the sheets alone is conveyed.

A sheet separated from the other sheets by the feed roller 6 and the retard roller 13 is turned around by the intermediate conveyance roller 7 to be conveyed in a different conveyance direction, that is, in a conveyance direction toward the back side of the apparatus, and reaches the registration roller pair 8. Then, the sheet is fed to the image forming part 9 at a timing adjusted by the registration roller pair 8.

The image forming part 9 forms a predetermined toner image on a sheet by an electro-photographic process, and includes a photosensitive drum 14 as an image carrier, and the image forming part 9 further includes a charging device 15, a developing device 16, a cleaning device 17, a transfer roller 18, and an exposure device (LSU) 19, which are disposed around the photosensitive drum 14. The photosensitive drum 14 is supported in a rotatable manner about an axis in a clockwise direction in FIG. 1. The transfer roller 18 is arranged to be opposed to the photosensitive drum 14 via the sheet conveyance path 4. The exposure device 19 is arranged above the photosensitive drum 14. Above the developing device 16, there is arranged a toner container 20, from which toner is replenished to the developing device 16.

When image data is fed from a host device such as a personal computer, first the charging device 15 uniformly charges a surface of the photosensitive drum 14. Then, a laser beam from the exposure device (LSU) 19 is applied to the photosensitive drum 14 to form thereon an electrostatic latent image based on the input image data. Further, the developing device 16 makes toner adhere to the electrostatic latent image to form a toner image on the surface of the photosensitive drum 14. The toner image formed on the photosensitive drum 14 is transferred by the transfer roller 18 onto a sheet supplied to a transfer nip (a transfer position) between the photosensitive drum 14 and the transfer roller 18.

The sheet, onto which the toner image has been transferred, is separated from the photosensitive drum 14 to be transferred to the fixing device 10. The fixing device 10 is arranged on a downstream side of the image forming part 9 in the sheet conveyance direction. The sheet, onto which the toner image has been transferred at the image forming part 9, is subjected to heating and pressurization by a heating roller 22 and a pressure roller 23 pressed against the heating roller 22, of which both are provided in the fixing device 10, and thereby the toner image on the sheet is fixed. Then, the sheet, which has undergone the image formation performed at the image forming part 9 and the fixing device 10, is delivered to the sheet delivery part 3 by the delivery roller pair 11.

After the transfer of the toner image, residual toner remaining on the surface of the photosensitive drum 14 is removed by the cleaning device 17, and residual charge remaining on the surface of the photosensitive drum 14 is eliminated by a static eliminator (not illustrated). Then, the photosensitive member 14 is charged again by the charging device 15, and subsequent image formation is performed in the same manner.

Figure 2:
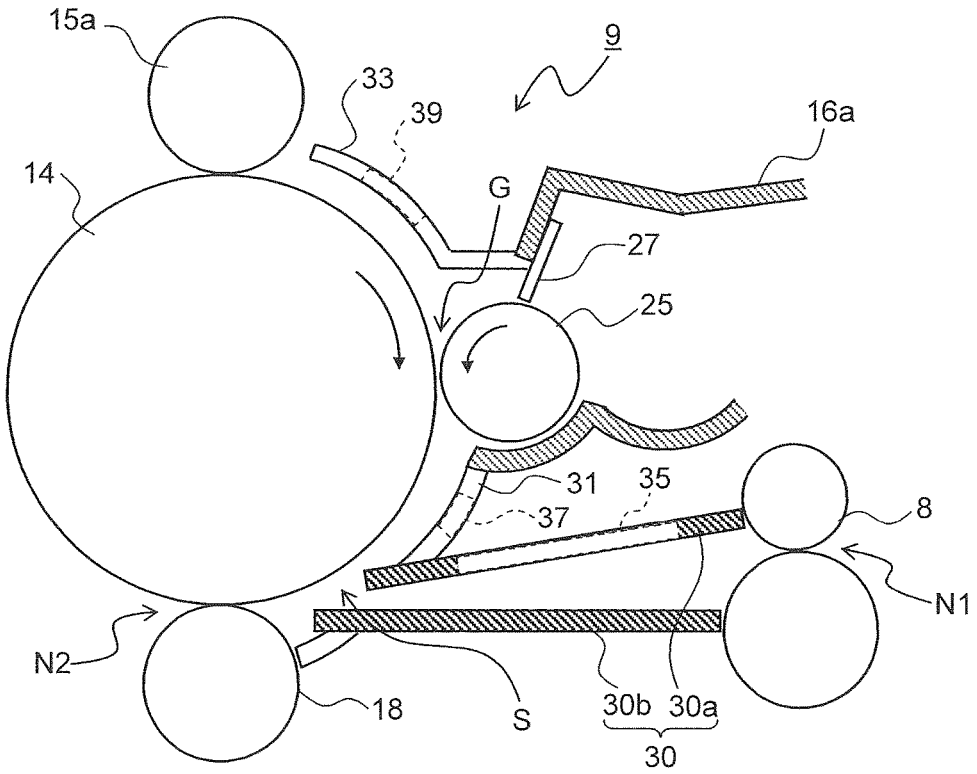
FIG. 2 is a partial enlarged view of an image forming part illustrated in FIG. 1.

FIG. 2 is partial enlarged view of an area around the image forming part 9 illustrated in FIG. 1. In FIG. 2, the cleaning device 17 is not illustrated. The charging device 15 includes a charging roller 15*a*, which contacts the photosensitive drum 14 to apply a charging bias to the surface of the photosensitive drum 14. The charging roller 15*a* is made of conductive rubber, and arranged in contact with the photosensitive drum 14. When the photosensitive drum 14 rotates in a clockwise direction in FIG. 2, the rotation causes the charging roller 15*a*, which contacts the surface of the photosensitive drum 14, to rotate in a counterclockwise direction in FIG. 2. At this time, a predetermined voltage is applied to the charging roller 15*a*, and thereby, the surface of the photosensitive drum 14 is uniformly charged.

The developing device 16 includes a developing housing 16*a*, in which a developing roller 25 and a restriction blade 27 are provided. The developing roller 25 is spaced from the photosensitive drum 14 by a predetermined gap (a developing gap) G. The developing housing 16*a* accommodates therein a one-component developer (hereinafter, simply referred to as toner) which contains a magnetic toner component alone. Toner is replenished to the developing device 16 from the toner container 20 (see FIG. 1).

The developing device 16 develops the electrostatic latent image formed on the photosensitive drum 14 by means of the developing roller 25 arranged opposite to the photosensitive drum 14 with the predetermined gap (the developing gap G) therebetween. Thickness of a toner layer on the developing roller 25 is restricted by the restriction blade 27. The developing roller 25 rotates in the counterclockwise direction in FIG. 2.

The transfer roller 18 contacts the photosensitive drum 14, and thereby forms a transfer nip N2, and transfers a toner image formed on the surface of the photosensitive drum 14 onto a sheet passing through the transfer nip N2. Connected to the transfer roller 18 are a transfer bias power supply and a bias control circuit (of which neither is illustrated) for applying, to the transfer roller 18, a transfer bias whose polarity is opposite to that of the toner.

Between the registration roller pair 8 and the transfer roller 18, a conveyance guide 30 is arranged. The conveyance guide 30 includes an upper conveyance guide 30*a* that faces an upper surface of the sheet and a lower conveyance guide 30*b* that faces a lower surface of the sheet.

Further, a first cover member 31 is arranged to face the photosensitive drum 14 over an area from the developing housing 16*a* to the transfer roller 18. Further, a second cover member 33 is arranged to face the photosensitive drum 14 over an area from the developing housing 16*a* to the charging roller 15*a*.

An upstream-side end part of the conveyance guide 30 with respect to the sheet conveyance direction is arranged in the vicinity of the registration roller pair 8. A lower end portion of the first cover member 31 is arranged in the vicinity of the transfer roller 18. Further, although not illustrated here, the first cover member 31 also covers both end parts, in an axial direction (a direction orthogonal to the sheet on which FIG. 2 is drawn), of each of the registration roller pair 8, the photosensitive drum 14, the developing housing 16*a*, and the transfer roller 18.

A nip (a registration nip N1) of the registration roller pair 8 and the transfer nip N2 both permit only a sheet to pass therethrough. Thus, according to the above configuration, it is only through the developing gap G between the photosensitive drum 14 and the developing roller 25 that air can flow into and out of a space surrounded by the photosensitive drum 14, the developing device 16, the registration roller pair 8, the transfer roller 18, the conveyance guide 30, and the first cover member 31.

That is, the photosensitive drum 14, the transfer roller 18, the developing roller 25, and the registration roller pair 8, together with the developing housing 16*a*, the conveyance guide 30 and the first cover member 31, which are arranged between the photosensitive drum 14, the transfer roller 18, the developing roller 25, and the registration roller pair 8, form a space S that is substantially sealed to prevent entry of external dust into an area ranging from the developing gap G to the transfer nip N2.

Figure 3:
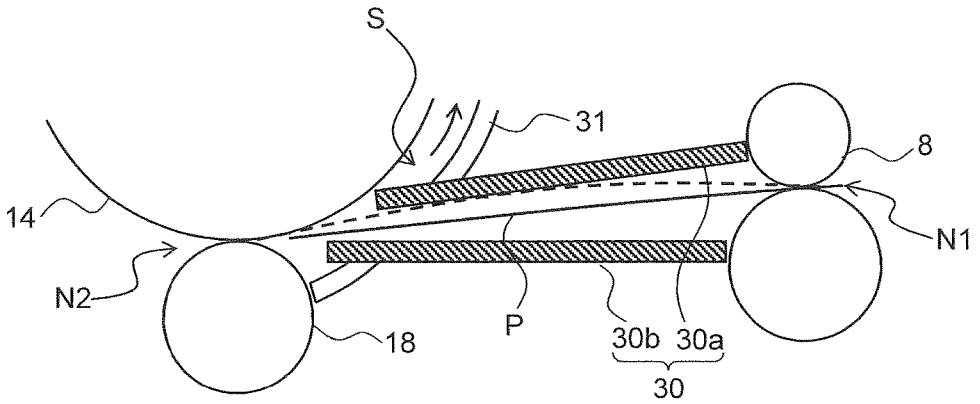
FIG. 3 is an explanatory diagram regarding displacement of a sheet observed when the sheet enters a transfer nip.
Figure 4:
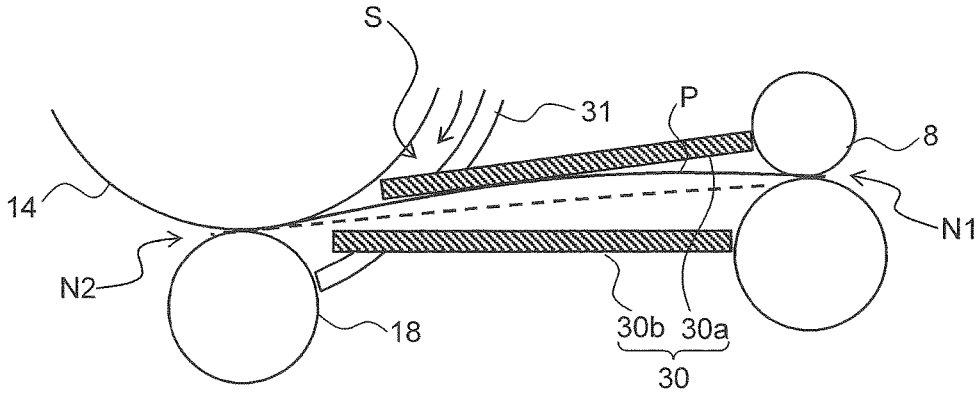
FIG. 4 is an explanatory diagram regarding displacement of a sheet observed when the sheet passes through a registration roller pair.

FIG. 3 and FIG. 4 are explanatory diagrams regarding displacement of a sheet observed when the sheet enters the transfer nip N2 and when the sheet passes through the registration roller pair 8, respectively. When a sheet P conveyed from the registration roller pair 8 enters the transfer nip N2, as illustrated in FIG. 3, a leading edge of the sheet P (indicated by a solid line) first hits the photosensitive drum 14. Then, impact of the hitting causes the sheet P to bend in a sheet surface direction orthogonal to the sheet conveyance direction (indicated by a broken line). At this time, the sheet P is bent to be convex toward the upper conveyance guide 30*a* side, as a result of which an air flow is generated in the space S to flow in a direction from the transfer nip N2 toward the developing gap G (a direction reverse to a rotation direction of the photosensitive drum 14).

Specifically, the displacement of the sheet P observed when its leading edge hits the photosensitive drum 14 is 20 to 30 $mm^2$ on a plane orthogonal to a central axis of the photosensitive drum 14, and the displacement takes place in 10 to 30 msec. Thereby, an air flow is generated to flow at a rate of 0.001 $m^2$/sec. The thus generated air flow is directed toward the developing gap G, which is the only opening via which inside and outside of the space S communicate with each other, but since the developing gap G is a narrow gap that is about 1 mm in width, an air flow at a maximum rate of 3 to 6 m/sec is generated at the developing gap G. Thus, even though the displacement of the sheet P is small, since the developing gap G is narrow, an air flow passes through the developing gap G at an increased rate.

On the other hand, when the sheet P passes through the registration roller pair 8, as illustrated in FIG. 4, a rear edge of the sheet P (indicated by a solid line) nipped by the registration nip N1 is released, so that the bent of the sheet P is cleared (indicated by a broken line). As a result, the sheet P is displaced in a direction approaching the lower conveyance guide 30*b*, whereby there is generated an air flow inside the space S in a direction from the developing gap G toward the transfer nip N2 (the same direction as the rotation direction of the photosensitive drum 14).

Then, under effect of the generated air flow, positions on the photosensitive drum 14 at which toner particles adhere to the photosensitive drum 14 after flying in the developing gap G from the developing roller 25 to the photosensitive drum 14 deviate from correct positions on the photosensitive drum 14 at which the toner particles should adhere to the photosensitive drum 14, and this results in image disturbance.

Figure 5:
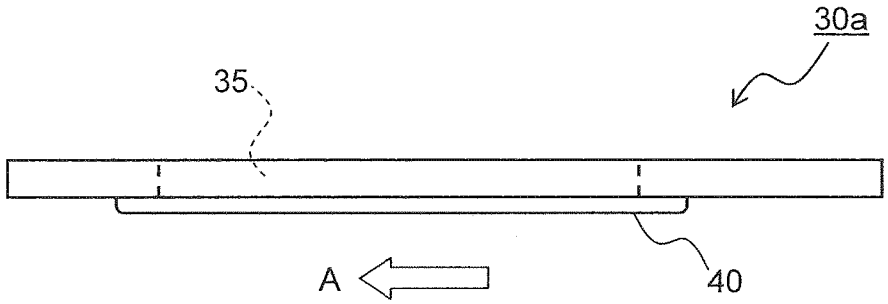
FIG. 5 is a side view of an upper conveyance guide of a conveyance guide used in the image forming apparatus of the first embodiment.
Figure 6:
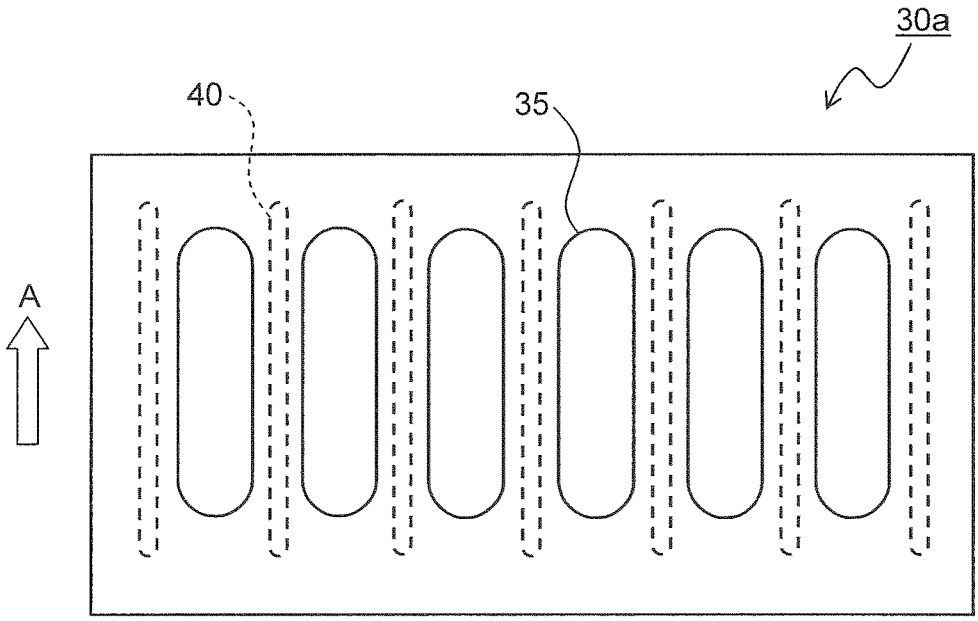
FIG. 6 is a plan view of the upper conveyance guide illustrated in FIG. 5, as seen from above.

FIG. 5 is a side view of the upper conveyance guide 30*a* of the conveyance guide 30 used in the image forming apparatus 100 of the first embodiment, and FIG. 6 is a plan view of the upper conveyance guide 30*a* as seen from above. In the present embodiment, in order to reduce generation of an air flow by the displacement of a sheet as illustrated in FIG. 3 and FIG. 4, there is formed a through hole 35 in the upper conveyance guide 30*a*.

The through hole 35 has an oblong shape of which a longitudinal direction is along the sheet conveyance direction (a direction indicated by an arrow A). The oblong shape of the through hole 35 helps make the leading edge of a sheet less likely to be caught by an opening edge of the through hole 35. Further, to secure a sufficient opening area, the through hole 35 includes a plurality of (here, six) through holes 35 arranged side by side in a sheet width direction (a left-right direction in FIG. 6).

On a surface (a lower surface in FIG. 5) of the upper conveyance guide 30*a*, the surface opposing the lower conveyance guide 30*b*, a plurality of ribs extending along the sheet conveyance direction are formed such that the through holes 35 are each arranged between adjacent ones of the ribs. The ribs 40 help prevent sheet jam from being caused by the leading edge of a sheet being caught by the through holes 35.

Referring back to FIG. 2, in the first cover member 31, at a part between the developing housing 16*a* and the upper conveyance guide 30*a* (on a downstream side of the developing gap G with respect to the rotation direction of the photosensitive drum 14), there is formed a positive pressure adjustment port 37. When the photosensitive drum 14 and the developing roller 25 rotate, air flows from the charging roller 15*a* side, through the developing gap G, and into the space S. The positive pressure adjustment port 37 is provided for the purpose of releasing air pressure (positive pressure) generated by the entry of this air flow into the space S.

Figure 7:
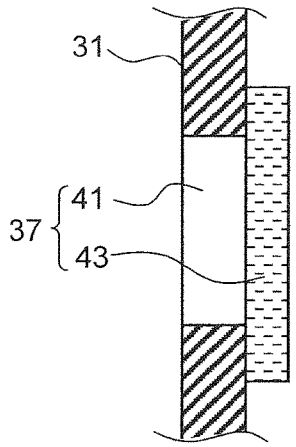
FIG. 7 is a partial sectional view of a positive pressure adjustment port formed in a first cover member.

FIG. 7 is a partial sectional view of the positive pressure adjustment port 37 formed in the first cover member 31. The positive pressure adjustment port 37 includes a vent hole 41, which is formed in the first cover member 31 and a filter 43 disposed on an outer side (a right side in FIG. 7) of the first cover member 31 to cover the vent hole 41. The positive pressure adjustment port 37 allows the space S to communicate with outside via the filter 43, and thereby prevents leakage of toner from inside the space S to outside, and also prevents entry of external dust into the space S.

In the second cover member 33, at a part between the developing housing 16*a* and the charging roller 15*a* (on an upstream side of the developing gap G with respect to the rotation direction of the photosensitive drum 14), there is formed a negative pressure adjustment port 39. The negative pressure adjustment port 39 is provided for the purpose of releasing air pressure (negative pressure) generated inside the second cover member 33 when the photosensitive drum 14 and the developing roller 25 rotate. The negative pressure adjustment port 39 is configured in the same manner as the positive pressure adjustment port 37 illustrated in FIG. 7.

According to the configuration of the present embodiment, with entry and exit of air via the through holes 35 formed in the upper conveyance guide 30*a*, pressure variation caused inside the space S by displacement of a sheet occurring when the leading edge of the sheet hits the photosensitive drum 14 and when the rear edge of the sheet passes through the registration roller pair 8. Accordingly, no air flow is generated to pass through the developing gap G, and thus it is possible to effectively reduce image disturbance.

Here, since the space S communicates with outside also via the positive pressure adjustment port 37, which is away from the conveyance guide 30, and the filter 43 is arranged on the positive pressure adjustment port 37, pressure loss is generated. As already described above, the displacement of the leading or rear edge of a sheet inside the conveyance guide 30 occurs in an extremely short time, and thus the positive pressure adjustment port 37 is not sufficient to reduce generation of an air flow caused by the displacement of a sheet. Further, if the through holes 35 are provided in the lower conveyance guide 30*b*, a sheet existing over the registration nip N1 and the transfer nip N2 separates the through holes 35 from a space where the developing gap G exists, and this makes it difficult to absorb pressure variation caused by the displacement of the sheet, which occurs in a short time.

Figure 8:
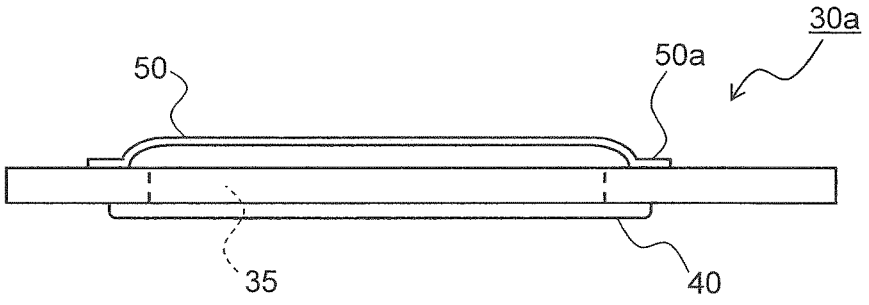
FIG. 8 is a side view of an upper conveyance guide of a conveyance guide used in an image forming apparatus according to a second embodiment of the present disclosure.
Figure 9:
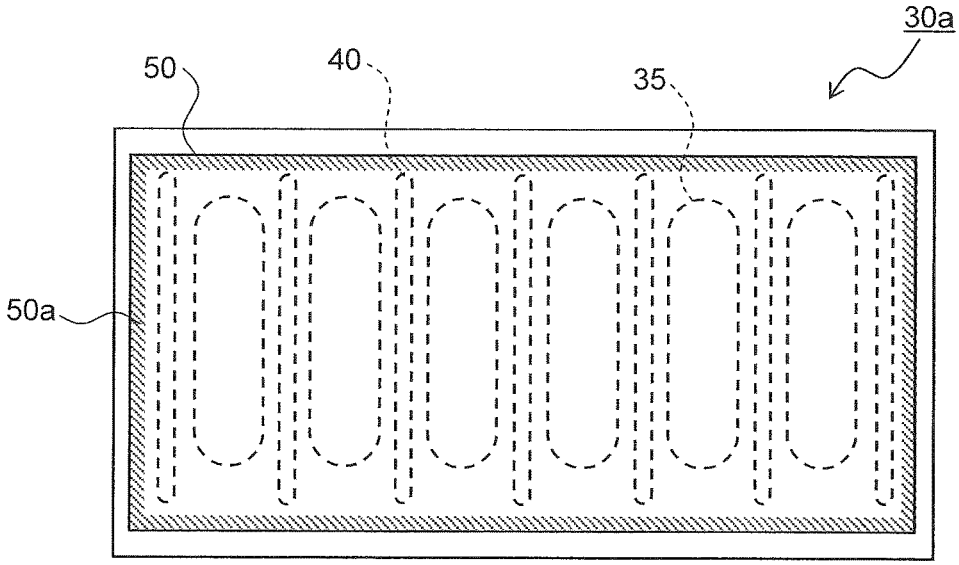
FIG. 9 is a plan view of the upper conveyance guide illustrated in FIG. 8, as seen from above.

FIG. 8 is a side view of an upper conveyance guide 30*a* of a conveyance guide 30 used in an image forming apparatus 100 according to a second embodiment of the present disclosure, and FIG. 9 is a plan view of the upper conveyance guide 30*a* as seen from above. In the present embodiment, there is provided a film 50, which covers an upper surface of the upper conveyance guide 30*a*. The other portions of the upper conveyance guide 30*a* are configured similar to those in the first embodiment.

The film 50 is arranged to cover all of through holes 35 formed in the upper conveyance guide 30*a*, with a bonding portion 50*a* formed in a peripheral part of the film 50 alone is bonded to the upper conveyance guide 30*a* with a double-adhesive tape. The film 50 is, for example, a polyethylene film, a polypropylene film, or the like, which is about 0.1 mm thick.

As a result of variation in volume of air (pressure variation) inside the space S caused by displacement of a sheet, the film 50 is deformed to be outwardly convex. The displacement of the sheet occurs in an extremely short time, and the film 50 is light-weighted and has a low rigidity, so that the film 50 is deformed without a delay from the displacement of the sheet. Thus, almost no air flow is generated by the displacement of the sheet, and accordingly, almost no air flow reaches the developing gap G.

The film 50 is resilient, and thus it recovers its original shape when the sheet recovers from the displacement, but since the film 50 has a low rigidity, the shape of the film 50 changes slowly. As a result, air gradually escapes from the positive pressure adjustment port 37 by the time when the film 50 recovers its original shape. Accordingly, there is no risk of an air flow being generated by the variation of the shape of the film 50 to reach the developing gap G.

According to the configuration of the present embodiment, by covering the through holes 35 with the film 50, it is possible to prevent entry of external dust into the space S. Furthermore, by appropriately selecting the thickness and the material of the film 50, it is also possible to reduce generation of an air flow caused by deformation of the film 50.

Figure 10:
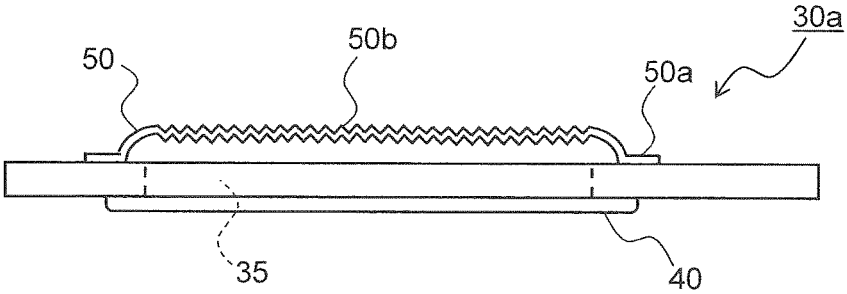
FIG. 10 is a side view of an upper conveyance guide of a conveyance guide used in an image forming apparatus according to a third embodiment of the present disclosure.
Figure 11:
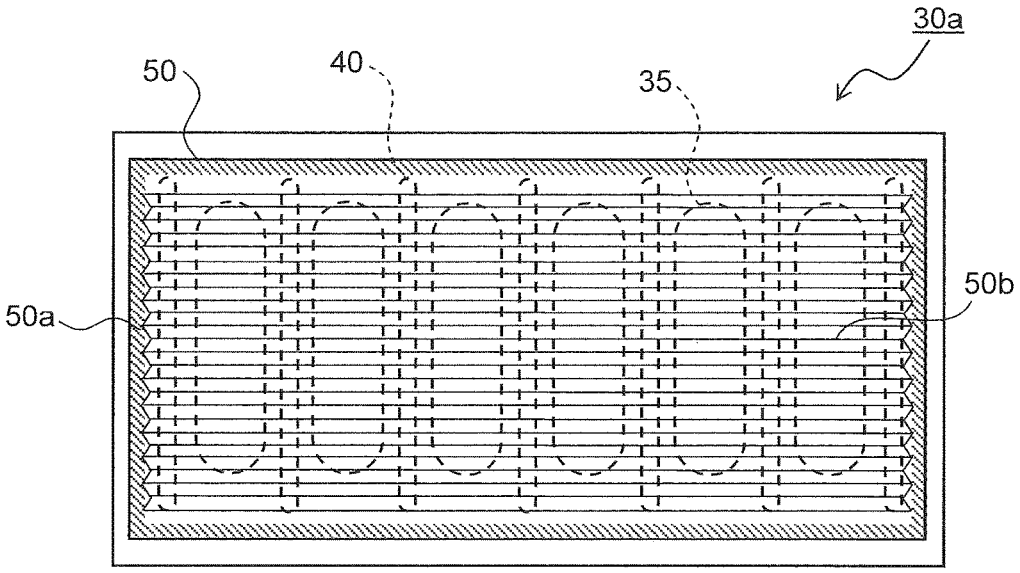
FIG. 11 is a plan view of the upper conveyance guide illustrated in FIG. 10, as seen from above.

FIG. 10 is a side view of an upper conveyance guide 30*a* of a conveyance guide 30 used in an image forming apparatus 100 according to a third embodiment of the present disclosure, and FIG. 11 is a plan view of the upper conveyance guide 30*a* as seen from above. In the present embodiment, a flexible portion 50*b* having a bellows shape is formed in a film 50, which covers through holes 35 formed in the upper conveyance guide 30*a*. The other portions of the upper conveyance guide 30*a* are configured similar to those in the second embodiment.

According to the configuration of the present embodiment, by forming the flexible portion 50*b* in the film 50, it becomes easy for the film 50 to be deformed. This makes it easy to absorb variation in volume of air (pressure variation) inside the space S caused by displacement of a sheet, and thus makes it possible to effectively reduce generation of an air flow passing through the developing gap G.

It should be understood that the present disclosure is not limited to the above embodiments, and various modifications are possible within the scope of the present disclosure. For example, instead of the charging device 15, which is a contact charging device using the charging roller 15*a* as illustrated in FIG. 2, there may be adopted a corona charging device including a corona wire and a grid. Furthermore, instead of the developing device 16, adopting the one-component developing method, there may be used a developing device adopting a two-component developing method using a two-component developer containing toner and magnetic carrier.

Moreover, the image forming apparatus 100 of the present disclosure is not limited to a monochrome printer as illustrated in FIG. 1, but may be any one of other image forming apparatuses, such as a monochrome copier, a digital multifunction peripheral, and a facsimile machine, which have a configuration in which airtightness of a space formed by a photosensitive drum, a developing device, a transfer member, and a registration roller pair is enhanced.

The present disclosure is usable in an image forming apparatus in which airtightness of a space formed by an image carrier, a developing device, a transfer member, and a registration roller pair is enhanced. Use of the present disclosure provides an image forming apparatus capable of effectively reducing image disturbance caused by an air flow generated by abrupt displacement of a recording medium.

What is claimed is:

1. An image forming apparatus, comprising:

an image carrier;

a charging device which charges a surface of the image carrier by applying a charging bias to the surface of the image carrier;

a developing device which is arranged on a downstream side of the charging device with respect to a rotation direction of the image carrier, includes a developer carrier opposing the image carrier with a predetermined developing gap therebetween, and a developing housing in which the developer carrier is housed, and develops an electrostatic latent image formed on the image carrier;

a transfer member which is arranged on a downstream side of the developing device with respect to the rotation direction of the image carrier, and transfers a toner image formed on the image carrier by the developing device onto a recording medium;

a registration roller pair which conveys the recording medium to a transfer nip between the transfer member and the image carrier at a predetermined timing;

a conveyance guide which includes a first conveyance guide opposing one surface of the recording medium conveyed from the registration roller pair to the transfer nip, the one surface being on a side of the image carrier, and a second conveyance guide opposing another surface of the recording medium, the other surface being on a side of the transfer member, wherein upstream-side end parts of the first conveyance guide and the second conveyance guide with respect to a conveyance direction of the recording medium are disposed near the registration roller pair, and a through hole is formed only in the first conveyance guide; and a first cover member which covers an area along a peripheral surface of the image carrier from a downstream-side end part of the developing housing with respect to the rotation direction of the image carrier to the transfer member, and forms a substantially sealed space together with the image carrier, the developing device, the transfer member, the registration roller pair, and the conveyance guide, with a lower end part of the first cover member being disposed near the transfer member, by having a lower end part of the first cover member disposed near the transfer member and by having downstream-side end parts of the first conveyance guide and the second conveyance guide with respect to the conveyance direction of the recording medium connected to the first cover member.

2. The image forming apparatus according to claim 1, wherein to the first conveyance guide, on a surface thereof on a side opposite to the second conveyance guide, a film covering the through hole is attached, the film being fastened, only in a peripheral part thereof, to the first conveyance guide.

3. The image forming apparatus according to claim 2, wherein a flexible portion having a bellows shape is formed in a surface of the film.

4. The image forming apparatus according to claim 1, wherein the through hole includes a plurality of through holes arranged in a direction orthogonal to the conveyance direction of the recording medium.

5. The image forming apparatus according to claim 4, wherein the through holes are oblong shaped, having a long side extending in the sheet conveyance direction.

6. The image forming apparatus according to claim 4, wherein on a surface of the first conveyance guide, the surface facing the second conveyance guide, a plurality of ribs extending along the conveyance direction of the recording medium are formed, and the through holes are each arranged between adjacent ones of the ribs.

7. The image forming apparatus according to claim 1, wherein the first cover member includes a positive pressure adjustment port including a vent hole and a filter covering the vent hole, the vent hole being formed on a downstream side of the developing gap with respect to the rotation direction of the image carrier.

8. The image forming apparatus according to claim 1, further comprising a second cover member which covers an area along the peripheral surface of the image carrier from an upstream-side end part of the developing housing with respect to the rotation direction of the image carrier to the charging device, and includes a negative pressure adjustment port including a vent hole and a filter covering the vent hole, the vent hole being formed on an upstream side of the developing gap with respect to the rotation direction of the image carrier.

* * * * *